US006864479B1

(12) United States Patent
Davis et al.

(10) Patent No.: US 6,864,479 B1
(45) Date of Patent: Mar. 8, 2005

(54) HIGH DYNAMIC RANGE MASS SPECTROMETER

(75) Inventors: Stephen Davis, Macclesfield (GB); Alexander A. Makarov, Cheadle (GB); Jonathan Hughes, Macclesfield (GB)

(73) Assignee: Thermo Finnigan, LLC, San Jose, CA (US)

( * ) Notice: Subject to any disclaimer, the term of this patent is extended or adjusted under 35 U.S.C. 154(b) by 26 days.

(21) Appl. No.: 10/070,118

(22) PCT Filed: Aug. 31, 2000

(86) PCT No.: PCT/GB00/03332

§ 371 (c)(1),
(2), (4) Date: Aug. 14, 2002

(87) PCT Pub. No.: WO01/18846

PCT Pub. Date: Mar. 15, 2001

(30) Foreign Application Priority Data

Sep. 3, 1999 (GB) ..... 9920711

(51) Int. Cl.[7] ..... H01J 49/04

(52) U.S. Cl. ..... 250/283; 250/287; 250/286; 250/397; 250/309; 250/394

(58) Field of Search ..... 250/283, 287, 250/286, 397, 309, 394, 305

(56) References Cited

U.S. PATENT DOCUMENTS

| | | | | |
|---|---|---|---|---|
| 4,691,160 A | | 9/1987 | Ino | |
| 4,851,673 A | | 7/1989 | Izumi et al. | |
| 5,026,988 A | | 6/1991 | Mendenhall et al. | |
| 5,077,470 A | * | 12/1991 | Cody et al. | 250/282 |
| 5,463,219 A | | 10/1995 | Buckley et al. | |
| 5,644,128 A | | 7/1997 | Wollnik et al. | |
| 5,644,220 A | | 7/1997 | Urs et al. | |
| 5,777,326 A | * | 7/1998 | Rockwood et al. | 250/287 |
| 5,898,173 A | | 4/1999 | Franzen | |
| 6,011,259 A | | 1/2000 | Whitehouse et al. | |
| 6,229,142 B1 | | 5/2001 | Bateman et al. | |
| 6,348,688 B1 | | 2/2002 | Vestal | |
| 6,559,444 B2 | | 5/2003 | Franzen | |
| 6,646,252 B1 | | 11/2003 | Gonin | |

FOREIGN PATENT DOCUMENTS

| | | |
|---|---|---|
| EP | 0597667 A | 5/1994 |
| GB | 0907511 A | 10/1962 |
| GB | 1147667 A | 4/1969 |
| GB | 2246468 A | 1/1992 |
| WO | WO9821742 | 5/1998 |
| WO | WO9840907 | 9/1998 |
| WO | WO9938190 | 7/1999 |
| WO | WO99/38191 | 7/1999 |
| WO | WO9967801 | 12/1999 |

OTHER PUBLICATIONS

Whitehouse et al. "Multiple Detector Systems", Pub. No: US 2002/0175292 A1, published Nov. 28, 2002.*

MJ Kristo et al., "System for Simultaneous Count/Current Measurement with a Duel–Mode Photo/Particle Detector", Review of Scientific Instruments, vol. 59(3), pp. 438–442, 1988, XP001013497.

* cited by examiner

*Primary Examiner*—John R. Lee
*Assistant Examiner*—Zia R. Hashmi
(74) *Attorney, Agent, or Firm*—Haynes and Boone, LLP

(57) ABSTRACT

A mass spectrometer comprises an ion source which produces an ion beam from a substance to be analysed and a detector to detect a quantity of ions incident thereon. The detector includes two elements (16, 18) each of which detect a part of the quantity of ions and an attenuation device attenuates the quantity of ions reaching one of the detector elements. At least one of the detector elements (16, 18) is connected to a time to digital converter (TDC) to allow counting of the ions and at least one of the detector elements is connected in parallel to both a time to digital converter (TDC) and an analogue to digital converter (ADC).

13 Claims, 7 Drawing Sheets

HIGH DYNAMIC RANGE MASS SPECTROMETER

This invention relates to a high dynamic range mass spectrometer, preferably although not exclusively of the time of flight kind.

Time of flight (TOF) mass spectrometers are often used for quantitative analysis of substances. In these applications of a TOF mass spectrometer, it will be necessary to be able to accurately determine the concentration of a substance based upon a detected ion signal. In a TOF mass spectrometer, the ion signals which are to be detected are usually fast transients and can be measured by analogue to digital conversion using a transient recorder or by ion counting as a function of time using a time to digital convertor (TDC). Use of a TDC is generally preferred because it can be more difficult to obtain accurate quantitative results using a transient recorder. The use of ion counting is further preferred in an orthogonal acceleration TOF because the signals to be measured tend to be small and the ion count rates are low. Ion counting using a TDC involves the TDC detecting the presence of a signal at the detector in excess of a predetermined threshold. If the signal detected is in excess of a predetermined threshold then this is deemed to be indicative of the presence of an ion at the detector and the TDC, after detection of the above threshold signal, increments a counter to count the ions.

However, a problem arises with a time to digital convertor when this is used to count ions in intense ion beams because most TDC's can only detect one event in a finite small time window. This means that where a TDC is used, it is not normally possible to distinguish between a single ion being detected and a multiplicity of ions being detected at the same time. This arises because a TDC cannot distinguish between different magnitudes of signal, only whether the detected signal exceeds the predetermined threshold. Accordingly, a counter connected to the TDC will only be incremented once upon detection of an above threshold signal regardless of its magnitude and therefore in the case of intense ion beams an accurate quantitative measurement cannot be made. This means that mass spectrometers incorporating such ion counters usually require there to be less than or equal to one ion per signal pulse of any substance to measured. It also means that for a single TDC there will be a relatively low dynamic range.

Attempts have been made to provide a mass spectrometer which uses one or more TDC's to count ions and in which the dynamic range can be extended for better quantitative measurements.

Thus for example, U.S. Pat. No. 5,777,326 discloses a TOF mass spectrometer in which the incoming ion beam is spread so as to be capable of being detected by three or more detectors. The signal at each detector is detected by a respective TDC and the signal from each TDC is subsequently added together. However, the problem with this type of arrangement is that simply spreading the beam over a number of detectors does not affect the intensity of the beam to a sufficient extent to significantly enhance dynamic range without a very large number of TDC's.

It is an object of the present invention to provide an alternative form of mass spectrometer in which ion counting can be used to cover a wide dynamic range using a small number of TDC's.

Thus and in accordance with the present invention therefore there is provided a mass spectrometer comprising a mass spectrometer comprising an ion source to produce ions from a substance to be detected and detector means to detect a quantity of ions incident on said detection means wherein the said detection means includes at least two detector elements, each of which elements detect at least a part of said quantity of ions from the ion source and attenuation means which acts to attenuate the quantity of ions reaching at least one said detection element, wherein at least one of said detection elements is connected to a time-to-digital converter (TDC) to allow counting of detected ions and at least one of said detection elements is connected in parallel to both a time-to-digital converter (TDC) and an analogue-to-digital converter (ADC) for ion detection.

With this arrangement it is possible to measure the quantity of ions with and without attenuation which means that both single and multiple ion detections can be quantified more accurately and a high dynamic range for the mass spectrometer can be achieved. This is achieved by parallel acquisition or interleaved acquisition of signal from ion beams with significant attenuation at one detector element and almost no attenuation at another.

Although the discussion has been in terms of using TDC acquisition it will be appreciated that the same principle of attenuation of signal to other detector elements could also be applied to extension of dynamic range using analogue-to-digital conversion (ADC) or combinations of TDC and ADC.

The detector elements may be disposed one behind the other relative to the ion source or alternatively may be disposed one above the other in a plane extending generally perpendicular to the direction of ion travel. In the case where the detector element is disposed one behind the other, an earthed member preferably a wire or grid may be provided between the elements to minimise capacitative coupling between these elements.

The attenuation means may be performed by at least one of the detector elements and in this case the at least one detector element is adapted to allow a proportion of incident signal to pass through the element without being detected. The adaptation may comprise a plurality of perforations or other apertures in the element. Alternatively a separate attenuation device may be provided between the ion source and the detector elements which acts to reduce the number of ions reaching at least one of said elements or at least a part thereof. In these circumstances the attenuation device may comprise a perforated plate.

Preferably, in the case where the attenuation means is formed by a perforation of the detector element, the cross-sectional area of the perforations compared to the total cross-sectional area of the plate is substantially 1 to 100.

The invention will now be described further by way of example and with reference to the accompany drawings of which:

Figure 1:
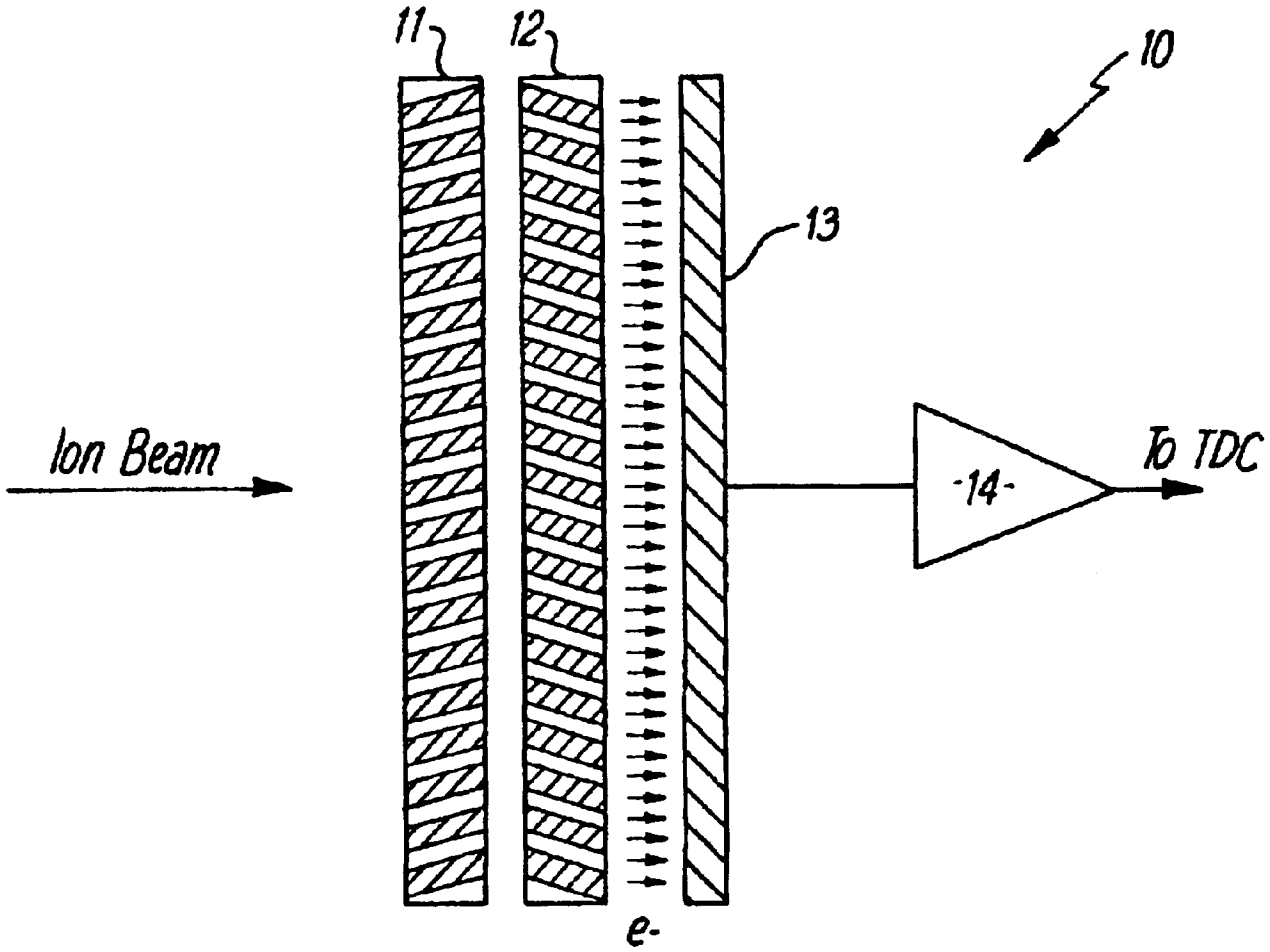
FIG. 1 shows a schematic version of a prior art form of mass spectrometer.

Referring now to the drawings, there is shown in FIG. 1 a schematic representation of one standard form of prior art mass spectrometer detector. The spectrometer 10 comprises an ion source (not shown) which produces an ion beam from a substance to be analysed. The ion beam is directed by conventional means onto a pair of microchannel plates 11,12 (hereinafter referred to as a chevron pair) which generates secondary electrons due to the collision of the ions in the ion beam with the material of the plates 11,12 in the microchannels. Secondary electrons generated are detected by a single plate anode 13, the detected signal is amplified in an amplifier 14 and is passed to a time to digital convertor (TDC) (not shown) which detects detected signals over a predetermined threshold and increments a counter to count these above threshold signals.

This form of mass spectrometer suffers from the problem that If an above threshold signal is detected by the TDC, the counter will be incremented only once regardless of the magnitude of the signal in exceeding the threshold. Thus even if the signal is of such a magnitude as to constitute more than one ion being detected, the counter will still only be incremented once. The TDC cannot distinguish between different magnitude above threshold signals. This means that the mass spectrometer is very inaccurate when used for quantitative measurements of intense signals.

Figure 2:
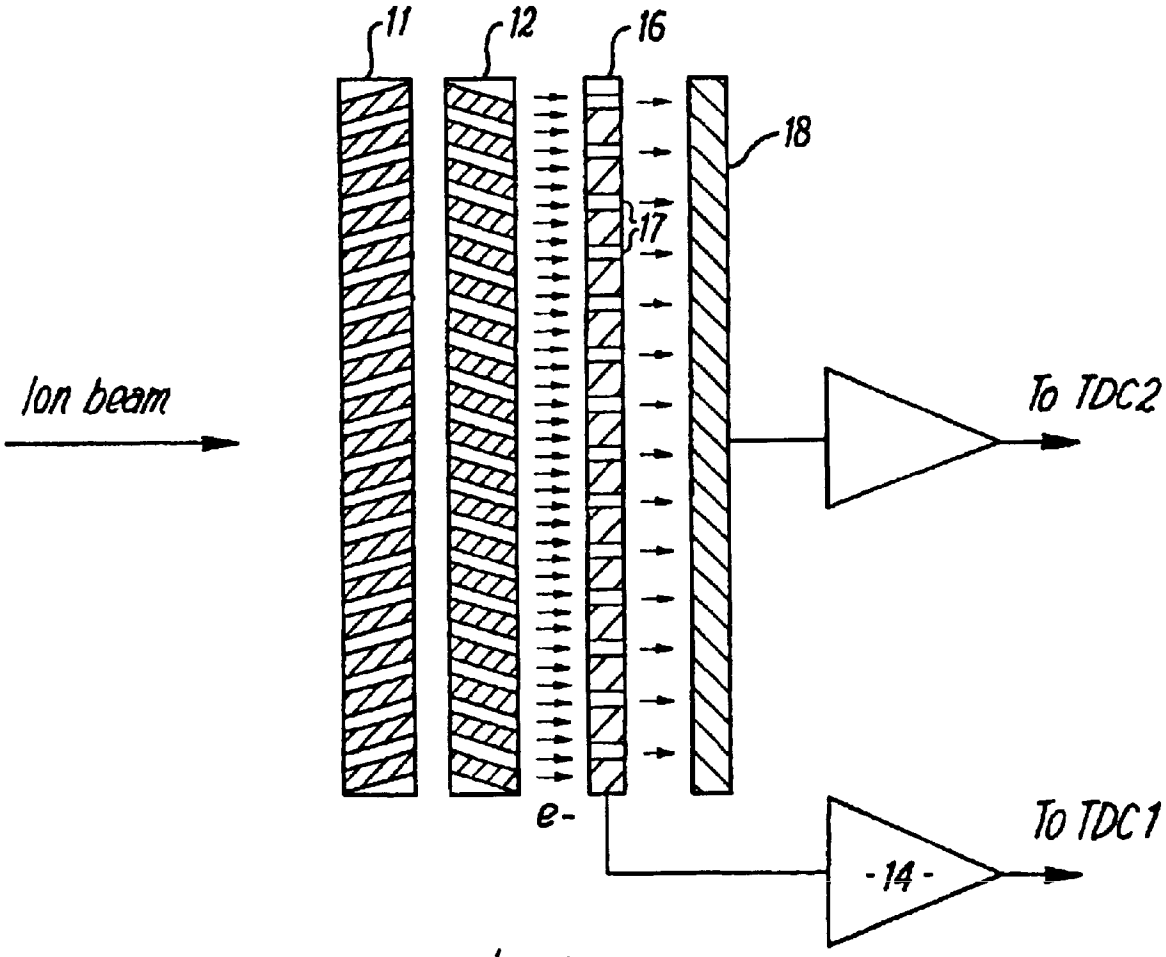
FIG. 2 shows a schematic version of one embodiment of mass spectrometer.

One form of mass spectrometer in accordance with the present invention is shown in schematic form in FIG. 2. in this arrangement, the ion beam generated by the ion source (not shown) is also incident on a chevron pair 11,12 as with the embodiment of FIG. 1. The ion beam strikes the microchannel plate 11 and causes the ejection of secondary electrons from the surface of the microchannels. The secondary electrons cause the ejection of further secondary electrons as they accelerate through the microchannels in the plates 11,12 which results in an electron beam which emerges from the chevron pair 11,12 being essentially an amplified signal version of the incoming ion beam. The secondary electron beam then strikes a first anode 16 for detection. The first anode 16 is perforated in order that some of the secondary electrons pass through the first anode 16 without being detected. The remainder of the secondary electrons strike the first anode 16 and are detected. For detection purposes, the first anode 16 is connected to an amplifier 14 and to a time to digital converter (not shown) the output of which increments a counter (not shown) as previously explained. Those secondary electrons which pass through the perforations 17 in the first anode 16 strike a second anode 18 placed substantially immediately behind the first anode 16 and are detected. The secondary anode is connected to a second amplifier and a second time to digital converter, the output of which increments a counter in the same manner as mentioned above.

It will be appreciated that the ratio of the cross-sectional area of the perforations to the total cross-sectional area of the anode can be chosen to give a particular degree of attenuation to the incoming secondary electron beam.

Thus, in use, the ion beam is directed onto the chevron pair 11,12. This results in the generation of secondary electrons in the manner mentioned above. These secondary electrons emerge from the chevron pair 11,12 and are incident of the first anode 16. It is thought that by arranging for the cross-sectional area of the perforations in the first anode to be of the order of 1% of the total cross-sectional area of the anode will give the possibility for more accurate quantitative measurements over a large dynamic range, however, it is to be appreciated that the ratio of the cross-sectional area of the perforations to the total area of the anode can be of any desired magnitude in order to give appropriate attenuation characteristics.

Therefore, if the area of the perforations represents approximately 1% of the total area of the anode, this means that 1% of the secondary electron beam which is incident on the first anode 16 will pass through that anode without being detected. This means that the intensity of any signal present at the first anode would be reduced by two orders of magnitude if measured at the second anode 1B. Therefore it would be appreciated that with this arrangement, that if for example the first anode 16 can be used to detect signals of a first two orders of magnitude then the second anode, at which the signal has been reduced in intensity by a factor of 100, can be used to detect signals at a second two orders of magnitude. It will be appreciated that this allows much more accurate quantitative analysis of the incoming ion beam since signals which are above threshold will be differentiated according to their magnitude and accordingly if a signal is of such a magnitude as to constitute more than one ion arriving, the present arrangement will detect this and the counters will be incremented by the respective TDC's by the correct number of ions. It can clearly be seen that this will result in a significant increase in the dynamic range of the mass spectrometer.

Figure 3:
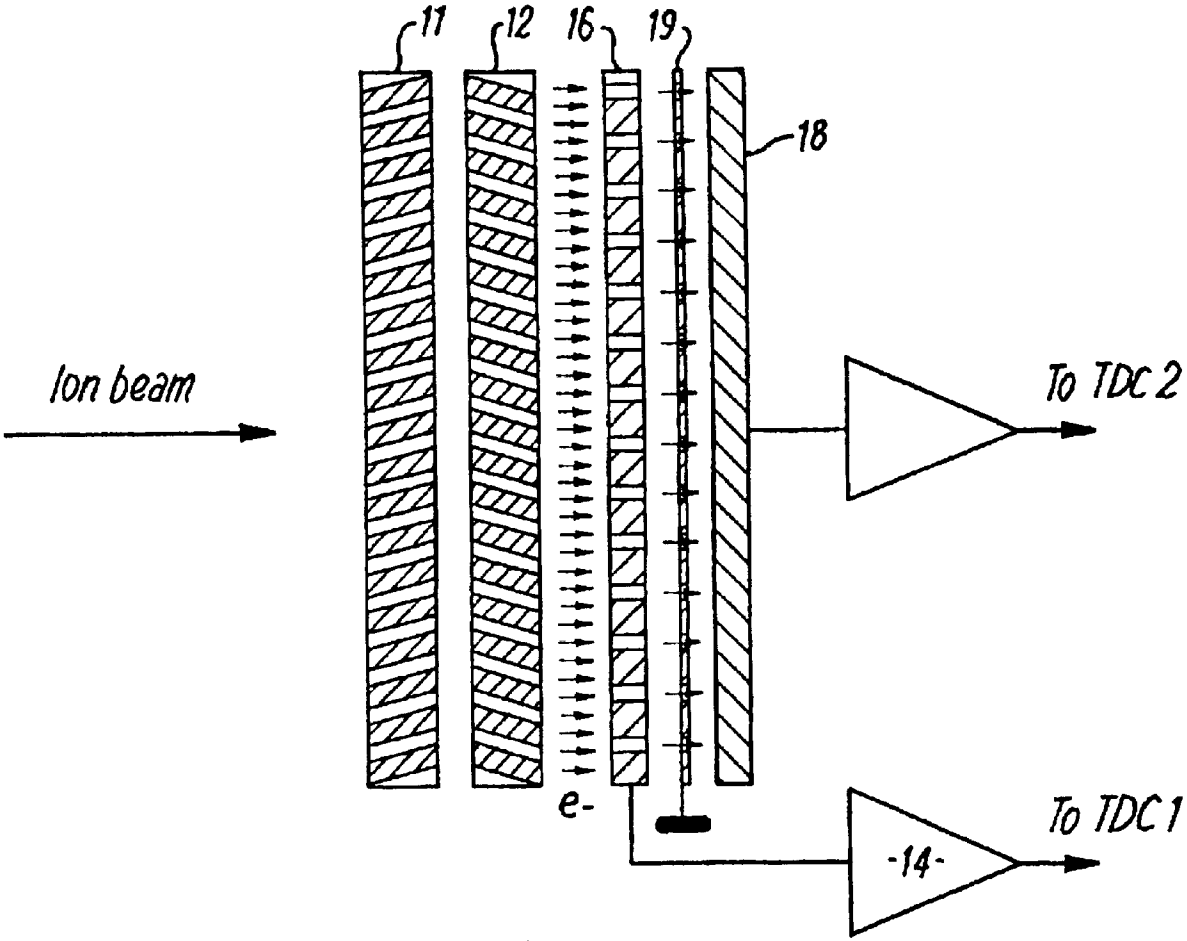
FIG. 3 shows a variation on the embodiment shown in FIG. 2.

FIG. 3 shows a variation on the embodiment of FIG. 2 in which an earthed grid 19 is positioned between the first and second anode 16 and 18. The earthed grid 19 assists in the minimisation of capacitative coupling effects between the two anodes 16 and 18.

Whilst in the embodiments of FIGS. 2 and 3, attenuation of the secondary electron signal is carried out by the perforated first anode 16, attenuation can be carried out in many different ways.

Figure 4:
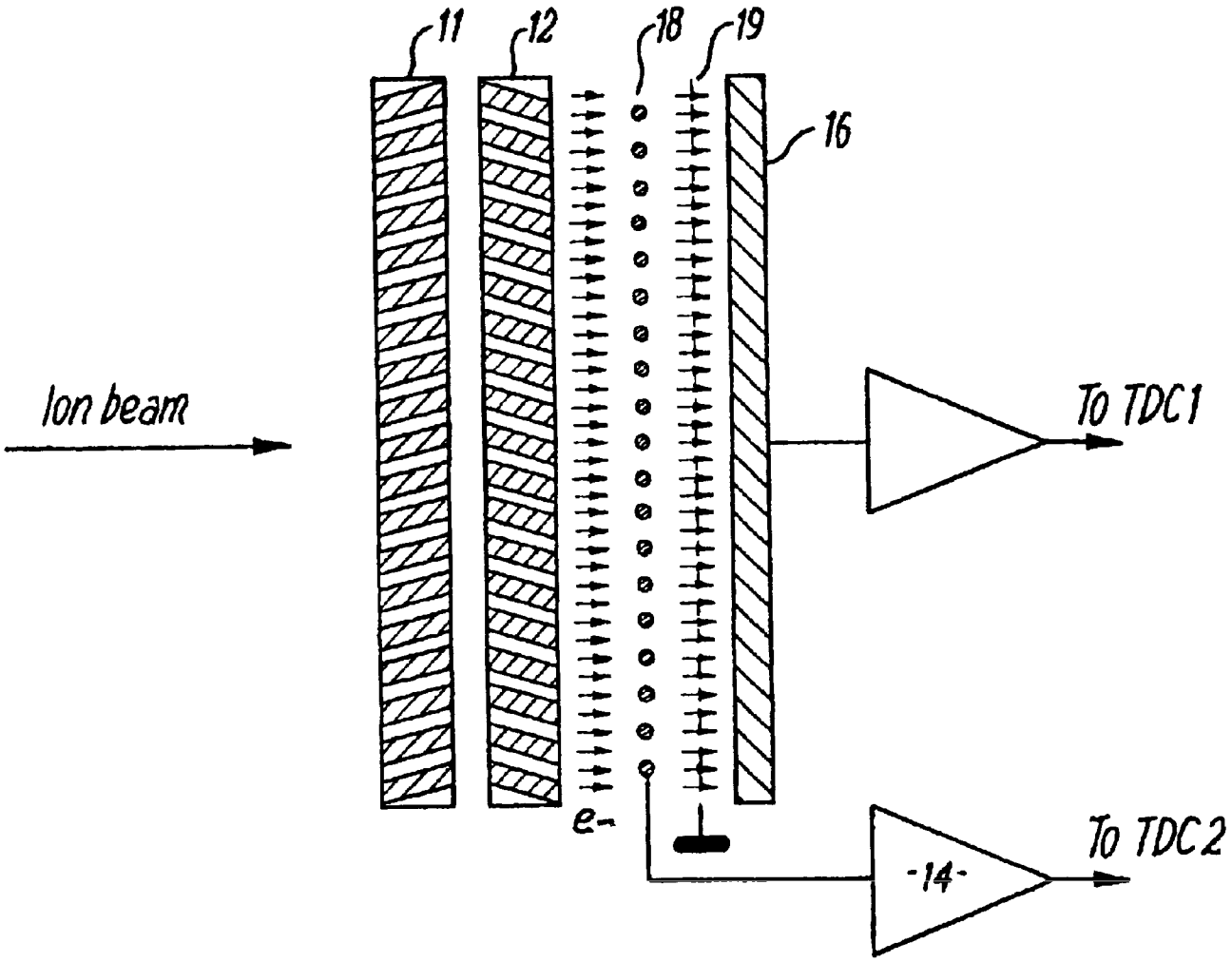
FIG. 4 shows a schematic version of a second embodiment of mass spectrometer.

Thus for example, as shown in FIG. 4, the attenuation can be carried out by wires or a grid placed in front of the first anode 16 to form the second anode 18. The cross-sectional area of the wire or grid compared to the cross-sectional area of the first plate anode is small such that a large proportion of the incident signal from the chevron pair 11,12 passes through the second anode 18 without being detected. As with the other embodiments, the attenuation can be varied by changing the cross-sectional area of the wire or grid to achieve a desired dynamic range. Furthermore, as with the other embodiments, an earthed grid 19 can be placed between the two anodes to minimise capacitative coupling of these anodes.

Figure 5:
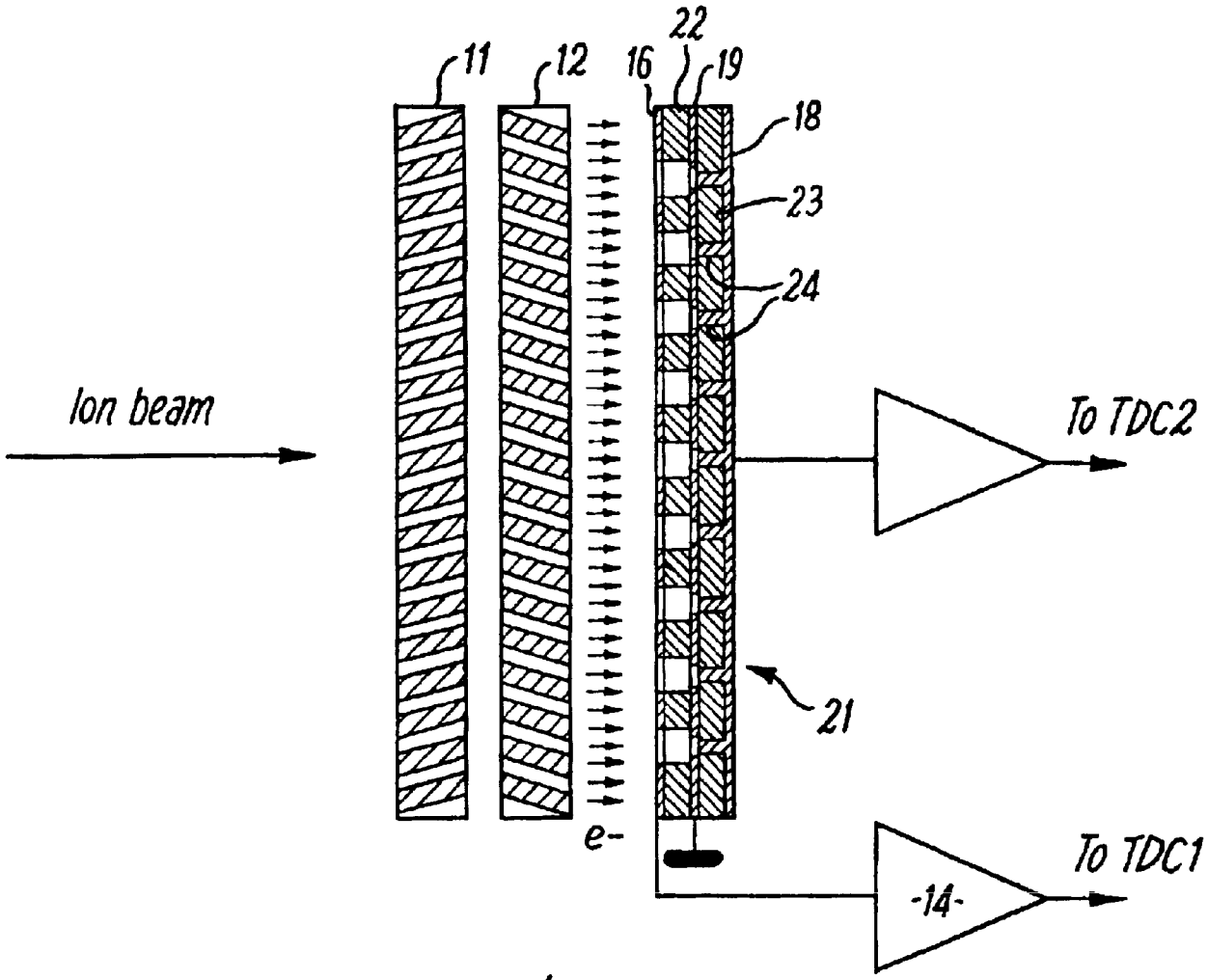
FIG. 5 shows a schematic version of a third embodiment of mass spectrometer.

A further alternative is shown in FIG. 5. in this embodiment, the first anode 16, a second anode 18 and, optionally an earthed grid 19, are constructed as sandwich layers of a printed circuit board 21. The first anode 16 is formed as a perforated plate attached to a first support layer 22 which is also perforated, the perforations in the first support layer 22 being in register with the perforations in the first anode 16. Attached to the opposite side of the first support layer 22 is an earthed gird, perforations in the grid also being in register with the perforations in the first support layer 22 and the first anode 16. Attached to the opposite side of the earthed grid 19 is a second support layer 23 which carries a second anode 18 attached thereto. Fingers 24 of the second anode 18 extend through the second support layer 23 and terminate adjacent to the perforations in the earthed grid 19.

In this embodiment, the attenuation is carried out by the first anode 16 and only a proportion of the secondary electrons reach the fingers 24 of the second anode 18 through the aligned apertures. As in the previous embodiments, the earthed grid 19 minimises capacitative coupling between the two anodes.

The embodiments of FIGS. 2–5 are not embodiments of mass spectrometer in accordance with the present invention.

Figure 6:
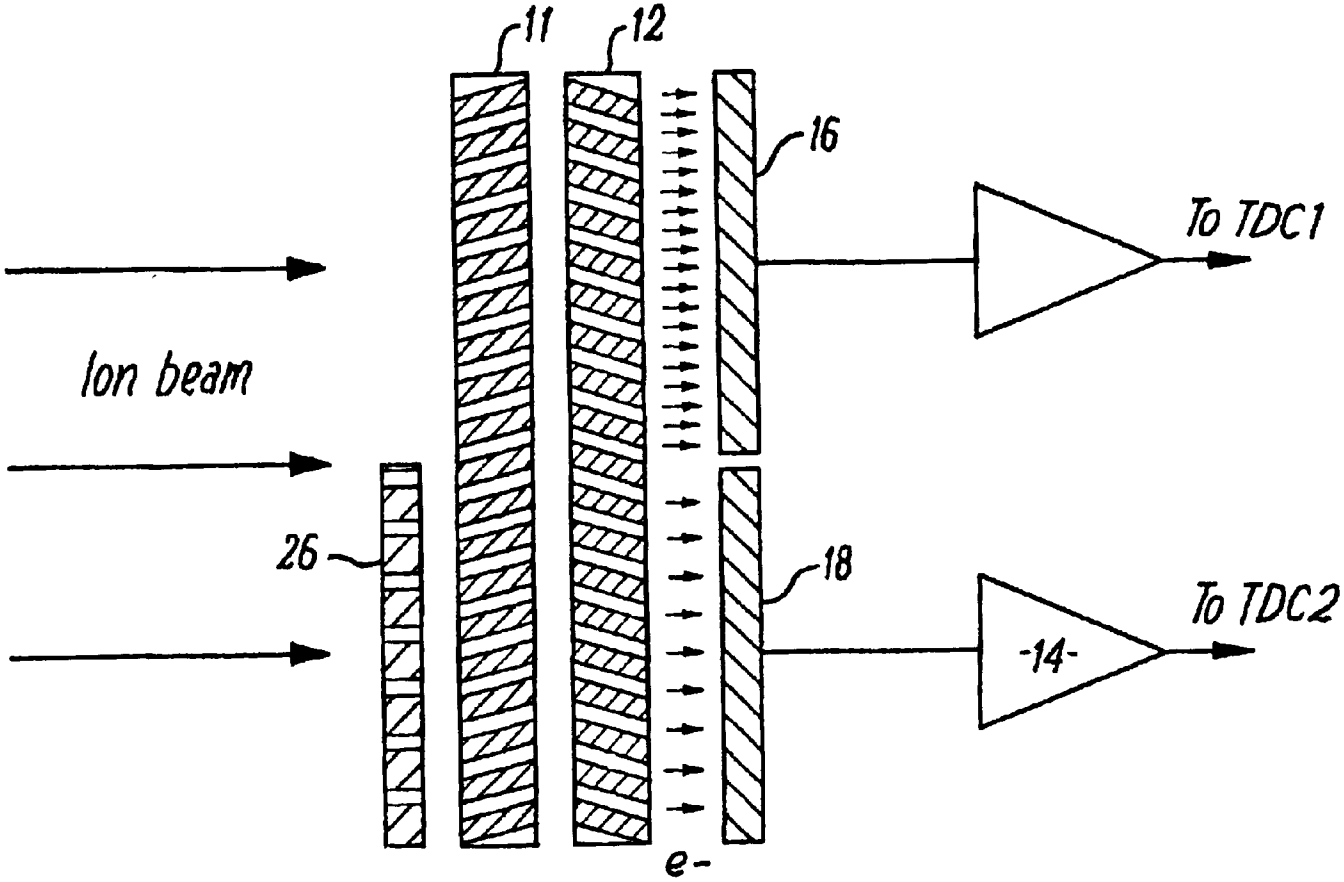
FIG. 6 shows a schematic version of a fourth embodiment of mass spectrometer in accordance with the present invention.

A still further alternative is shown in FIG. 6 in which a separate attenuation element 26 of appropriate form is placed in the ion beam before the ion beam is incident on the chevron pair 11,12. The attenuation element in this embodiment, comprises a perforated plate, and is arranged so as to interfere only with a part of the incoming ion beam and reduces the proportion of that part of the beam which reaches the chevron pair 11,12. In this embodiment, the first anode 16 and the second anode 18 are also provided but they are provided in the same plane extending generally parallel to the longitudinal axis of the chevron pair 11,12 as spaced therefrom. Thus the attenuation element attenuates only a part of the incoming ion beam which, after passing through the chevron pair 11,12 and generating secondary electrons, is incident on the second anode 18. The unattenuated part of the incoming ion beam after passing through the chevron pair 11,12 is incident on the first anode 16. Therefore it will be appreciated that the same effect is achieved with this embodiment as is achieved in the other embodiments.

Figure 7:
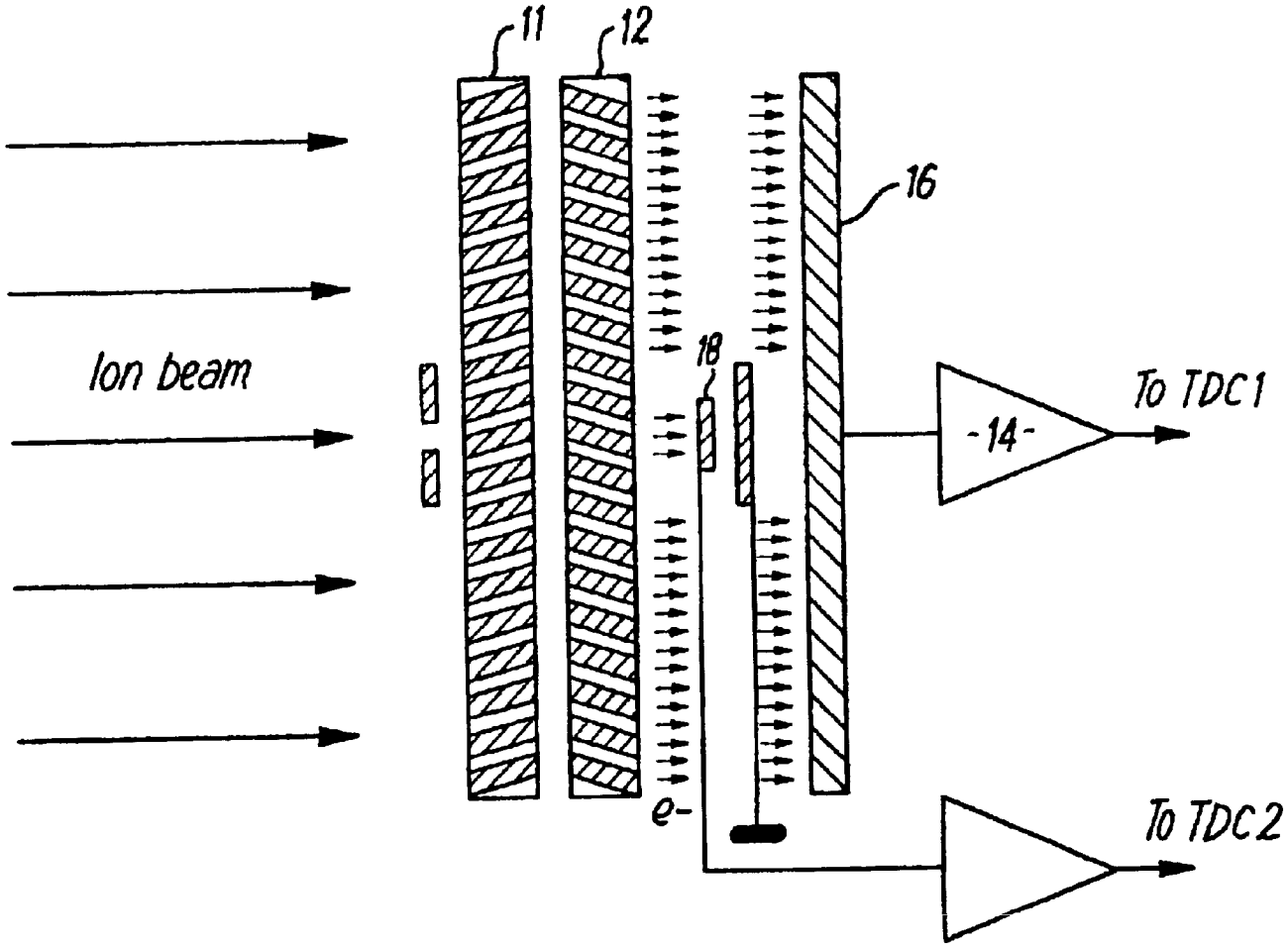
FIG. 7 shows a schematic version of a fifth embodiment of mass spectrometer in accordance with the present invention.

It will of course be appreciated that the overall attenuation required may also be achieved by a combination of attenuation of the incident ion beam reaching an area of the microchannel plates detector and attenuation of the secondary electron signal, for example FIG. 7.

It will further be appreciated that attenuation can be achieved by a combination of restricting the proportion of ion beam reaching a part of the chevron pair 11,12 (as in the embodiment of FIG. 6) with a restriction on the secondary electron signal emerging from the chevron pair (as in the embodiment of FIG. 4). An example of an embodiment of this type is shown in FIG. 7. In this embodiment, the incident ion beam is attenuated by a perforated member placed before the chevron pair 11,12. Also the secondary electron signal emerging from the chevron pair 11,12 is attenuated by placing a relatively small second anode in front of an relatively large first anode.

It will be appreciated that It is the attenuation of the incoming ion beam or the secondary electrons ejected from the chevron pair 11,12 which allows the TDC elements to more accurately count incoming ions over a large dynamic range. The use of attenuation means that it is possible to discriminate between different magnitude above threshold signals giving rise to a more accurate quantitative analysis of the incoming ion beam and also giving rise to an extension to the dynamic range of the mass spectrometer.

It is of course to be understood that the invention is not intended to be restricted to the details of the above embodiment which are described by way of example only.

What is claimed is:

1. A mass spectrometer comprising an ion source to produce ions from a substance to be detected and detector means to detect a quantity of ions incident on said detector means wherein the said detector means includes at least two detector elements, each of which elements detect at least a part of said quantity of ions from the ion source, attenuation means and means for generating secondary electrons from said ions, wherein the attenuation means are placed before any of the means for generating secondary electrons and act to attenuate the quantity of ions reaching at least one said detector element relative to another of the at least two detector elements, and wherein at least one of said detector elements is connected to a time-to-digital converter (TDC) to allow counting of detected ions and at least one of said detector elements is connected in parallel to both a time-to digital converter (TDC) and an analogue-to digital converter (ADC) for ion detection.

2. A mass spectrometer according to claim 1, wherein attenuation means is such that both incident ions and secondary electrons generated by said incident ions are attenuated.

3. A mass spectrometer according to claim 1, wherein an earthed grid is provided between the elements to minimise capacitive coupling between elements.

4. A mass spectrometer according to claim 1, wherein the at least one detector element is adapted to allow a proportion of incident signal to pass through the element without being detected.

5. A mass spectrometer according to claim 4, wherein the adaptation of the at least one detector comprises a plurality of perforations or other apertures in the element.

6. A mass spectrometer according to claim 1, wherein the attenuation device comprises a perforated plate.

7. A mass spectrometer according to claim 5, wherein the cross-sectional area of the perforations compared to the total cross-sectional area of the plate is approximately 1 to 100.

8. A mass spectrometer according to claim 1, wherein each detector element comprises a separate plate anode.

9. A mass spectrometer according to claim 1, wherein each detector element is connected via an amplifier to a time to digital converter (TDC) to allow counting of detected ions.

10. A mass spectrometer according to claim 1, wherein the detector elements are disposed one behind the other relative to the ion source.

11. A mass spectrometer according to claim 1, wherein the detector elements are disposed one above the other in a plane extending generally perpendicular to the direction of ion travel.

12. A mass spectrometer according to claim 1, wherein the attenuation means is formed by at least one of the detector elements.

13. A mass spectrometer according to claim 1, wherein said attenuation device is provided between the ion source and the detector elements which acts to reduce the number of ions reaching at least one of said elements or at least a part thereof.

* * * * *